United States Patent [19]

Henders

[11] Patent Number: 4,693,295

[45] Date of Patent: Sep. 15, 1987

[54] DEVICE FOR CONTINUOUS CASTING

[75] Inventor: Siegfried Henders, Geldern, Fed. Rep. of Germany

[73] Assignee: Korf Engineering GmbH, Düsseldorf, Fed. Rep. of Germany

[21] Appl. No.: 881,031

[22] PCT Filed: Oct. 16, 1985

[86] PCT No.: PCT/DE85/00404

§ 371 Date: Jun. 17, 1986

§ 102(e) Date: Jun. 17, 1986

[87] PCT Pub. No.: WO86/02298

PCT Pub. Date: Apr. 24, 1986

[30] Foreign Application Priority Data

Oct. 17, 1984 [DE] Fed. Rep. of Germany ..... 3438482

[51] Int. Cl.[4] ..... B22D 11/06

[52] U.S. Cl. ..... 164/433; 164/482

[58] Field of Search ..... 164/433, 434, 482

[56] References Cited

U.S. PATENT DOCUMENTS 2,206,930 7/1940 Webster ..... 164/433 X
2,246,907 6/1941 Webster ..... 164/449
4,030,537 6/1977 Ward ..... 164/433
4,117,880 10/1978 Cimetiere et al. ..... 164/433

FOREIGN PATENT DOCUMENTS 861273 2/1961 United Kingdom ..... 164/433

*Primary Examiner*—J. Reed Batten, Jr.

[57] ABSTRACT

In a device for continuous casting that uses a casting wheel (5) molten material is fed into a recess that runs around the outer periphery of the casting wheel in tangential direction, the recess being open to the outside. During the rotational movement of the casting wheel the material hardens partially in the recess, with the formation of a solid skin. At least in the section up to the formation of the solid skin the recess is closed off by an endless steel strip (6) that passes over guide rollers (7,8,9), the strip (6) being pressed against the casting wheel. The application force for the steel strip is exerted by a chain (11) that is arranged—viewed from the casting wheel—in the pressure area behind the steel strip. This chain is subjected to a corresponding tensile force. To this end, one (10) of the guide rollers (8,9,10) for the chain is installed so as to be movable and subjected to a force that generates the tensile force in the chain.

5 Claims, 2 Drawing Figures

DEVICE FOR CONTINUOUS CASTING

Figure 1:
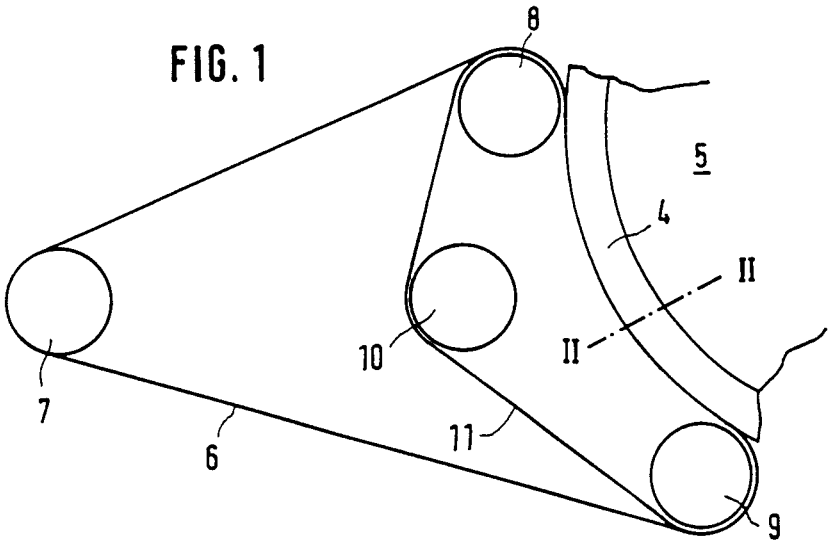

The present invention relates to a device for continuous casting, in which the melted material is fed into a recess that runs along the outer periphery of a casting wheel in the direction of the circumference of said wheel, said recess being open to the outside in a radial direction, the material hardening in part in this recess during the rotational movement of the casting wheel, before the casting that is so formed is removed from the recess by means of a band that closes off in the direction of the circumference, at least partially, the recess that is filled with the material, said band pressing against the casting wheel.

In a known device of this kind the band consists of an endless steel strip that passes over three guide rollers. One of these three guide rollers is mounted in such a manner as to render it movable and is subject to a force such that there is a specific tension in the steel strip.

This tension is essential in order to generate the pressure of the steel band against the casting wheel. However, because of the high temperature of the melted material and the large amount of tension that is involved, the steel strip is subjected to considerable loads, with the result that it wears very rapidly and thus has to be replaced very frequently.

Thus, it is the task of the present invention to create a casting device of the type described in the introduction hereto, in which the amount of wear on the band is considerably reduced.

According to the present invention, this task has been solved in that a separate pressure element is provided, this being behind the band so as to press the band against the casting wheel. This pressure element consists preferably of a rotating chain. This chain and the band can pass over three guide rollers, of which two are used jointly by the chain and by the band. In an advantageous configuration at least one of the guide rollers for the chain is installed so as to be movable and subjected to a force that generates tension in the chain.

Figure 2:
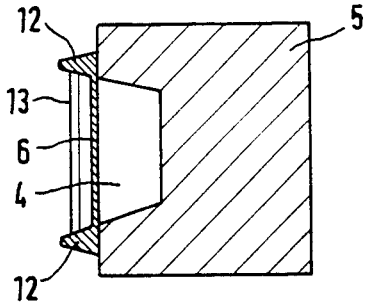

The present invention will be described below on the basis of an exemplary version illustrated in the drawings appended hereto. These drawings are as follows:

FIG. 1: A continuous casting device in principle, in a side view;

FIG. 2: A section on the line II—II in FIG. 1, perpendicular to the plane of the drawing.

The installation that is shown in the drawings permits continuous casting and, combined with an associated rolling plant, makes it possible to produce a finished product such as steel rod, simple profiles, or rolled wire continuously from the melt heat of the molten steel. This continuous operation of a casting installation in conjunction with a rolling plant results in a considerable reduction in costs.

In known manner, the installation comprises a tundish 1 filled with molten steel from a transport ladle (not illustrated herein). The tundish is used to position the casting stream very precisely and, during sequential casting operations, as a buffer when the ladles are being changed. The molten steel passes through a nozzle into a recess 4 in a casting wheel 5. This recess runs in the direction of the periphery of the casting wheel 5 and forms a closed groove. This is of trapezoidal shape, which is to say that—in the radial direction—its inner surface is somewhat narrower than the outer surface. As an example, the inner surface is approximately 130 mm long in the axial direction of the casting wheel, whereas the depth of the recess 4 is 128 mm, for example. The recess 4 is open to the outside in the radial direction. It is preferred that the casting wheel consist of a steel frame and a water-cooled copper ring that embodies the recess 4.

At least in the area of the still molten steel filling the open side fo the recess 4 is closed off by a steel band 6 that rotates with it. This steel band moves over a length of approximately one-quarter of the circumference of the casting wheel 5 with the casting wheel, and consists of an endless steel strip that passes over three guide rollers 7, 8, and 9 in such a manner that the steel band is not subjected to significant tensile loads.

An endless chain 11 passes over the guide rollers 8 and 9 and an extra guide roller 10 in such a manner that in the section between the guide rollers 8 and 9 the steel band 6 is located between the casting wheel 5 and the chain 11. The guide roller 10 is installed so as to be movable, a force this acting on this guide roller 10 so as to maintain a specific tension in the chain 11. This tension in the chain 11 ensures that the steel band is pressed tight against the casting wheel 5, so that the recess 4 is sealed off tightly to the outside and the molten steel within the recess is unable to escape.

The formation of a link in the chain 11 is shown in FIG. 2 in cross-section. According to the drawing, the chain link has outer ribs 12 that press the steel band 6 on the edges of the recess 4 firmly against the casting wheel 5. The ribs 12 are connected to each other by a bridge 13. This passes at a distance above the steel strip 6 so that this is not subjected to any radial application pressure across the recess 4 itself. The ribs 12 of the individual links abut directly against each other with the result that they form a continuous line of application pressure on both sides of the steel strip 6.

Because of the fact that the pressure of the steel strip against the casting wheel is achieved not by a tensile force generated in the steel band itself, but by a separate pressure element, the mechanical loading to which the band is subjected is greatly reduced. In this way, it is simple to ensure that the wear on the band is reduced to one-tenth or less of its former value.

The steel within the recess 4 hardens during the rotation of the casting wheel 5 between the two guide rollers 8 and 9 to the point that a solid skin is formed. This partially-hardened billet is loosened from the recess 4, in a manner well known in the art, by means of a water-cooled chisel and passed to a bending zone and a straightener. The casting wheel is brushed clean as it continues to rotate, dried, and sprayed with casting (release) oil.

The billet is cooled down in the bending zone by spray cooling, so that the molten steel remaining within the billet is hardened under controlled conditions. It is then bent in a succession of rollers and finally straightened in a straightener.

Finally, the billet passes through a so-called equalizer zone wherein there is no additional cooling and the temperature is equalized in the billet. At the end of the equalizer zone the temperature field is homogenous across its complete cross-section. It can then be passed directly to the rolling plant.

I claim:

1. A continuous casting device comprising: a rotatable casting wheel having a circumferential recess which is open radially outwardly for receiving molten material therein which is to harden at least partially therein during rotation of said casting wheel; a band confining said recess radially outwardly of said wheel over at least part of the circumference of the wheel; and a chain passing over said band radially outwardly of said band, said chain having a plurality of individual links; each link having two parallel ribs pressing the band against the circumference of the wheel outside said recess, and also having a bridge connecting said ribs, said bridge being out of contact with said band, whereby pressure is exerted on the band by the chain only outside said recess.

2. A device according to claim 1, wherein said band is a steel strip.

3. A device according to claim 2, wherein said chain passes over three guide rollers, said steel strip passing over two of said rollers.

4. A device according to claim 3, wherein at least one of said rollers passed over by said chain is movable, for tensioning said chain.

5. A device according to any one of claims 1 to 4, wherein said ribs form a continuous line of pressure against said band.

* * * * *